US005425632A

United States Patent [19]

Kazunori et al.

[11] Patent Number: 5,425,632

[45] **Date of Patent: * Jun. 20, 1995**

[54] PROCESS FOR BURNING COMBUSTIBLE MIXTURES

[75] Inventors: Kazunori Tsurumi, Fujisawa; Nobuyasu Ezawa, Koto, both of Japan; Ralph A. Dalla Betta, Mountain View, Calif.

[73] Assignees: Catalytica, Inc., Mountain View, Calif.; Tanaka Kikinzoku Kogyo K.K., Japan

[ * ] Notice: The portion of the term of this patent subsequent to Jan. 25, 2011 has been disclaimed.

[21] Appl. No.: 88,614

[22] Filed: Jul. 6, 1993

Related U.S. Application Data

[63] Continuation of Ser. No. 617,976, Nov. 26, 1990, abandoned.

[51] Int. Cl.[6] ..... F23D 21/00

[52] U.S. Cl. ..... 431/7; 502/339

[58] Field of Search ..... 431/7, 328, 170; 60/723; 502/262, 233, 339, 527; 422/170, 171; 48/127.7

[56] References Cited

U.S. PATENT DOCUMENTS

| | | | |
|---|---|---|---|
| 3,259,589 | 7/1966 | Michalko | 502/333 X |
| 4,118,199 | 10/1978 | Volker et al. | 422/171 |
| 4,270,896 | 6/1981 | Polinski et al. | 422/171 X |
| 4,331,631 | 5/1982 | Chapman et al. . | |
| 4,366,668 | 1/1983 | Madgavkar et al. . | |
| 4,414,023 | 11/1983 | Aggen et al. . | |
| 4,521,532 | 6/1985 | Cho . | |
| 4,572,904 | 2/1986 | Onal | 502/333 |
| 4,601,999 | 7/1986 | Retallick et al. . | |
| 4,650,782 | 3/1987 | Onal | 502/339 |
| 4,673,663 | 6/1987 | Magnier . | |
| 4,731,989 | 3/1988 | Furuya et al. . | |
| 4,742,038 | 5/1988 | Matsumoto . | |
| 4,752,599 | 6/1988 | Nakamura et al. . | |
| 4,784,984 | 11/1988 | Yamakaka et al. . | |
| 4,831,009 | 5/1989 | Retallick . | |
| 4,870,824 | 10/1989 | Young et al. | 431/328 X |
| 4,893,465 | 1/1990 | Farrauto et al. . | |
| 5,026,611 | 6/1991 | Usui et al. | 502/527 X |
| 5,281,128 | 1/1994 | Dalla Betta et al. | 502/527 |

FOREIGN PATENT DOCUMENTS

| | | | |
|---|---|---|---|
| 0198948 | 10/1986 | European Pat. Off. | 431/7 |
| 0266875 | 5/1988 | European Pat. Off. | 502/333 |
| 57-210207 | 12/1982 | Japan . | |
| 60-14938 | 1/1985 | Japan . | |
| 60-14939 | 1/1985 | Japan . | |
| 60-26211 | 2/1985 | Japan . | |
| 60-51543 | 3/1985 | Japan . | |
| 60-51544 | 3/1985 | Japan . | |
| 60-51545 | 3/1985 | Japan . | |
| 60-54736 | 3/1985 | Japan . | |
| 60-60411 | 4/1985 | Japan . | |

(List continued on next page.)

OTHER PUBLICATIONS

Kee et al., *Sandia National Laboratory Report No. SAND87-8215* (1987).

Kubaschewski et al., *International Series on Materials Science and Technology*, 24(5):382.

Pennline et al., *Ind. Eng. Chem. Process Des. Dev.*, 18(1):156–162, (1979).

*Primary Examiner*—Carl D. Price

*Attorney, Agent, or Firm*—Morrison & Foerster

[57] ABSTRACT

This invention is a process for catalytically burning a combustible mixture of a fuel and an oxygen-containing gas. In particular, the invention is a process for producing a combustion gas at a selected temperature, preferably between 1050° C. and 1700° C., by introducing all of the fuel necessary to attain that temperature to a combustion catalyst, partially combusting the combustible within the combustion catalyst, and homogeneously combusting the remainder of the fuel outside the catalyst. By controlling the temperature within the catalyst, deterioration of that catalyst is prevented.

5 Claims, 5 Drawing Sheets

FOREIGN PATENT DOCUMENTS

| | | |
|---|---|---|
| 60-60424 | 4/1985 | Japan . |
| 60-66022 | 4/1985 | Japan . |
| 60-147243 | 8/1985 | Japan . |
| 60-175925 | 9/1985 | Japan . |
| 60-196511 | 10/1985 | Japan . |
| 60-200021 | 10/1985 | Japan . |
| 60-202235 | 10/1985 | Japan . |
| 60-202745 | 10/1985 | Japan . |
| 60-222145 | 11/1985 | Japan . |
| 60-238148 | 11/1985 | Japan . |
| 61-33233 | 2/1986 | Japan . |
| 61-38627 | 2/1986 | Japan . |
| 61-147014 | 7/1986 | Japan . |
| 61-235609 | 10/1986 | Japan . |
| 61-237905 | 10/1986 | Japan . |
| 61-252408 | 11/1986 | Japan . |
| 61-252409 | 11/1986 | Japan . |
| 62-41511 | 2/1987 | Japan . |
| 62-46116 | 2/1987 | Japan . |
| 62-49125 | 3/1987 | Japan . |
| 62-79847 | 4/1987 | Japan . |
| 62-80419 | 4/1987 | Japan . |
| 62-80420 | 4/1987 | Japan . |
| 62-84215 | 4/1987 | Japan . |
| 62-112910 | 5/1987 | Japan . |
| 62-125210 | 6/1987 | Japan . |
| 62-158910 | 7/1987 | Japan . |
| 62-261803 | 11/1987 | Japan . |
| 63-41720 | 2/1988 | Japan . |
| 63-80847 | 4/1988 | Japan . |
| 63-190644 | 8/1988 | Japan . |
| 63-213723 | 9/1988 | Japan . |
| 60205116 | 10/1988 | Japan . |
| 63-267804 | 11/1988 | Japan . |
| 1-139911 | 6/1989 | Japan . |
| 1-210707 | 8/1989 | Japan . |
| 1-242151 | 9/1989 | Japan . |
| 60205115 | 11/1989 | Japan . |

PROCESS FOR BURNING COMBUSTIBLE MIXTURES

This application is a continuation, of application Ser. No. 07/617,976, and filed Nov. 26, 1990 now abandoned.

FIELD OF THE INVENTION

This invention is a process for catalytically burning a combustible mixture of a fuel and an oxygen-containing gas. In particular, the invention is a process for producing a combustion gas at a selected temperature, preferably between 1050° C. and 1700° C., by introducing all of the fuel necessary to attain that temperature to a combustion catalyst, partially combusting the combustible within the combustion catalyst, and homogeneously combusting the remainder of the fuel outside the catalyst. By controlling the temperature within the catalyst, deterioration of that catalyst is prevented.

BACKGROUND OF THE INVENTION

One widely used process for the generation of electricity entails the use of a fuel-fired turbine to turn a generator. The turbine turns by the introducing a hot exhaust gas through the turbine. In this process, catalysts have been used for igniting and burning the combustible fuel. The fuel and an oxygen-containing gas, typically air, are mixed and introduced into a combustion apparatus containing the catalysts. The mixture is burned over the catalysts and the resulting high temperature exhaust gas is introduced into the turbine. The efficiency of the generation process is largely dependent upon the temperature of the gas introduced into the turbine. That is to say, the higher the temperature of the burned gas, the higher the efficiency of the turbine at least so long as the turbine's materials are able to withstand the high temperatures. A typically appropriate temperature range for modern gas turbines is between 1300° C. and 1500° C.

Although it is desirable to introduce all of the needed fuel and oxygen-containing gas needed to reach a desired exhaust gas temperature into the catalyst, it is quite difficult to control the temperature within that catalyst.

At present, we do not know of any catalyst which is capable of operating at the desired turbine gas temperature of 1300° C. or above for an appreciable period of time without substantial deterioration of the catalyst. Others have suggested that controlling catalyst temperatures at a level at which catalyst deterioration is minimized may be accomplished by introducing the needed fuel into the catalyst in a series of stages rather than introducing all of the fuel together. This approach obviously requires the separation of the catalyst bed into a series of separate beds in which the temperature rise in each is separately controlled.

However, even this suggested process does not possess the ability consistently to produce an exhaust gas at a temperature over 1300 ° C. since the catalyst in the latter stages must face that temperature and consequently will deteriorate. Additionally, since the fuel is introduced into the catalyst at a number of points, the apparatus surrounding the catalyst is complex and its operation is complicated. Exhaust gases containing up to 10 ppm $NO_x$ or more may be produced because the fuel in the final stage is likely imperfectly or nonuniformly mixed with the partially combusted gases from the earlier stages.

In contrast, however, the present invention does not cause the temperature of the exhaust gas in the catalyst structure does not rise to a level which will cause the catalyst to undergo deterioration. The gas will be at a temperature, however, that will allow homogeneous combustion of uncombusted fuel to occur after the partially combusted gas leaves the catalyst bed. In other words, the resulting gas is ultimately produced at a temperature which is at or above the deterioration temperature of the catalyst without deteriorating the catalyst.

Additional fuel and air need not be supplied to the intermediate stages of the of the catalyst since all of the fuel needed to produce the desired exhaust temperature is supplied initially to the catalyst. No fuel concentration gradient in the catalyst bed is needed to suppress $NO_x$ production. Finally the complicated apparatus needed to supply fuel to the various catalyst stages of that known process is not needed.

DESCRIPTION OF THE INVENTION

Figure 1:
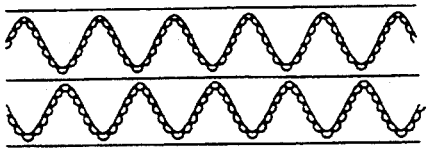
FIG. 1 is a schematic and view of a corrugated catalyst structure having catalytic material on one side of the structure surface.

This inventive process avoids the deterioration of the catalysts employed in the catalytic combustion apparatus by limiting the temperature in the catalyst to a level less than about, for example, 1000° C. to 1200° C., or such temperature that the catalyst does not deteriorate. The gas, as it leaves the catalyst, will contain some amount of unburned fuel which will be at a temperature which will undergo homogeneous combustion to a higher temperature, for example, 1300° C. to 1500° C., suitable for introduction to a gas turbine. This homogeneous combustion takes place at a position which is sufficiently remote from the catalyst so that the catalyst is not harmed. The process of the present invention contemplates initially supplying to the catalyst, all fuel needed for the ultimately desired temperature.

This process may be used with a variety of fuels and at a broad range of process conditions.

Although normally gaseous hydrocarbons, e.g., methane, ethane, and propane, are highly desirable as a source of fuel for the process, most fuels capable of being vaporized at the process temperatures discussed below are suitable. For instance, the fuels may be liquid or gaseous at room temperature and pressure. Examples include the low molecular weight hydrocarbons mentioned above as well as butane, pentane, hexane, heptane, octane, gasoline, aromatic hydrocarbons such as benzene, toluene, ethylbenzene; and xylene; naphthas; diesel fuel, kerosene; jet fuels; other middle distillates; heavy distillate fuels (preferably hydrotreated to remove nitrogenous and sulfurous compounds); oxygen-containing fuels such as alcohols including methanol, ethanol, isopropanol, butanol, or the like; ethers such as diethylether, ethyl phenyl ether, MTBE, etc. Low- BTU gases such as town gas or syngas may also be used as fuels.

The combustion catalysts employed in this invention may be of a single type on an appropriate support but, because the catalyst structure may desirably be separated into a number of stages, different catalysts may be used in different stages.

The preferred supports for the catalyst of this invention comprise metal, inorganic oxides, or ceramics. Suitable ceramic support materials are known in the art. Various appropriate inorganic oxides which may be used as supports include silica, alumina, silica-alumina, titania, zirconia, etc., and may be used with or without additives such as barium, cerium, lanthanum, or chromium added for stability. Metallic supports in the form of honeycombs, spiral rolls of corrugated sheet (which may be interspersed with flat separator sheets), columnar (or "handful of straws"), or other configurations having longitudinal channels or passageways permitting high space velocities with a minimal pressure drop are desirable in this service.

One way contemplated by the inventors for limiting the temperature of the catalyst to an acceptable value involves placement of the catalyst in the support so that only a portion of the combustible gas is in contact with a catalyst as it passes through the catalyst structure and the remaining portion of the gas is merely in contact with the support. This segregation of gas is accomplished by placing catalyst on only a number of the longitudinal passageways through the catalyst support while maintaining other passageways catalyst-free. In this way, the fuel in the combustible mixture flows through the catalyst-free passageways without being burned. It is additionally desirable to place the catalysts in the passageways so that the catalytic materials are in heat exchange relationship with the catalyst-free passageways.

The process of this invention desirably employs a three stage reaction apparatus having palladium as the catalytic material in the first two stages and using platinum as the catalytic material in the third stage. The corrugated supports mentioned above may be used in any stage but desirably are used at least in the second and third stages. Other catalytic materials may be utilized in the third stage in place of palladium and platinum, including, such materials as the other platinum group metals, base metal (Fe, Mn, Co, etc.) oxides, and refractory metal oxides.

Another method for inhibiting the combustible mixture's contact with the combustion catalyst involves forming a barrier layer on the catalyst. Suitable barrier materials include alumina, silica, zirconia, titania, and other inorganic oxides having low catalytic combustion activity. Alumina is the least desirable of these materials.

The process normally would be practiced at the operating pressure of the gas turbine. Compression of combustion air to the operating pressure typically would produce an air stream at a temperature of about 300° C. This stream is then mixed with the fuel stream and introduced into the first stage catalyst. The fuel in the compressed combustible mixture then ignites and the temperature of the mixture rises. The partially combusted stream then passes to the second catalytic stage where the temperature continues to rise because of its contact with the palladium catalyst contained in that stage. As was noted above, it is desirable to use a catalyst support having catalyst on only a portion of the catalyst support passageways in this stage. Only a portion of the uncombusted fuel is therefore burned in this stage and the temperature rise is moderated.

An additional reason for the moderation of the temperature found in these earlier stages lies in the use of the palladium catalyst.

Palladium is very active at 325° C. and lower for methane oxidation and can "light off" or ignite fuels at low temperatures. It has also been observed that in certain instances, after palladium initiates the combustion reaction, the catalyst rises rapidly to temperatures of 750° C. to 800° C. at one atm of air or about 940° C. at ten arm total pressure of air. These temperatures are the respective temperatures of the transition points in the thermogravimetric analysis (TGA) of the palladium/palladium oxide reaction shown below at the various noted pressures. At that point the catalytic reaction slows substantially and the catalyst temperature moderates at 750° C. to 800° C. or 940° C., depending on pressure. This phenomenon is observed even when the fuel/air ratio could produce theoretical adiabatic combustion temperatures above 900° C. or as high as 1700° C.

One explanation for this temperature limiting phenomenon is the conversion of palladium oxide to palladium metal at the TGA transition point discussed above. At temperatures below 750° C. at one atm of air, palladium is present mainly as palladium oxide. Palladium oxide appears to be the active catalyst for oxidation of fuels. Above 750° C. to 800° C., palladium oxide converts to palladium metal according to this equilibrium:

$$PdO \rightarrow Pd + \tfrac{1}{2}O_2$$

Palladium metal appears to be substantially less active for hydrocarbon oxidation so that at temperatures above 750° C. to 800° C. the catalytic activity decreases appreciably. This transition causes the reaction to be self-limiting: the combustion process rapidly raises the catalyst temperature to 750° C. to 800° C. where temperature self-regulation begins. This limiting temperature is dependent on $O_2$ pressure and will increase as the $O_2$ partial pressure increases.

A Mendelev Group IB or IIB metal may be added to the palladium as a catalyst adjunct. The addition of the adjuncts to the palladium catalyst shifts the equilibrium or self-limiting temperature of the resulting catalyst downward. The preferred adjunct metal is silver. It may be added by incorporating it into the a liquid carrier as a complex, compound or metal dispersion. After the liquid carrier is applied to the carrier, it may be decomposed by heat and the resulting substrate calcined. For instance, silver may be added as silver acetate, silver nitrate, or an organic silver complex. The metal is preferably added to make a molar ratio of the adjunct metal to the palladium in the range of 0.05 to 0.8. A preferred range is a ratio between 0.3 to 0.3.

It is also possible to control the temperature in the first two stages by incorporating barrier layers on the catalysts.

In any event, the partially combusted gas is then passed to the third stage. The desired platinum of the third stage is not oxidized in the same manner as is palladium. The third stage desirably utilizes the catalytic and catalyst-free passageways noted above. Consequently, a portion of the uncombusted fuel entering the third stage remains uncombusted and thereby moderates the temperature increase of the third stage so that the resulting gas temperature reaches a level of about 1000° C. to 1200° C.

Because of the choice of catalyst and catalyst structures and the fact that the gas leaving the third stage contains uncombusted fuel, that mixture is at a temperature where the combustion continues after it leaves the catalyst. No flame occurs however and the $NO_x$ remains at a low level. In contrast to the prior art methods where additional fuel is added to the final stage, the inventive process of this invention does not do so and eliminates the complexity associated with such an addition.

In the practice of the inventive process, the temperature of the exhaust gas after the homogeneous combustion is at a level of about 1300° C. to 1500° C. without the addition of more fuel. This gas temperature approaches the adiabatic combustion temperature for the particular combustible mixture of fuel and oxygen-containing gas at the pressure of operation. This gas temperature level is sufficient so that it may be used effectively and efficiently in the operation of a gas turbine. Yet the gas produces no pollution problems in that the level of $NO_x$ production is practically nil.

Although the present invention has been described in connection with the operation of a high temperature gas turbine, this inventive process is not limited to the use of the product gas in such a turbine.

EXAMPLES

Example 1

A three stage catalyst system was assembled.

Stage 1

The first stage was prepared as follows:

A 3% palladium/$ZrO_2$ sol was prepared. A sample of 145 g of $ZrO_2$ powder with a surface area of 45 $m^2$/gm was impregnated with 45 ml of a palladium solution prepared by dissolving $Pd(HN_3)_2(NO_2)_2$ in $HNO_3$ containing 0.83 g palladium/ml. This solid was dried, calcined in air at 500° C., and loaded into a polymer lined ball mill with 230 ml $H_2O$, 2.0 ml concentrated $HNO_3$, and cylindrical zirconia media. The mixture was milled for eight hours.

To 50 cc of this sol (containing about 35% solids by weight) 36 ml of palladium solution was added. The pH was adjusted to about nine and 1.0 ml of hydrazine added. Stirring at room temperature resulted in the reduction of the palladium. The final palladium concentration was 20% palladium/$ZrO_2$ by weight.

A cordierite monolithic ceramic honeycomb structure with 100 square cells per square inch (SCSI) was immersed in the palladium/$ZrO_2$ sol and the excess sol blown from the channels. The monolith was dried and calcined at 850° C. The monolith contained 6.1% $ZrO_2$ and 1.5% palladium. This monolith was again dipped in the same palladium/$ZrO_2$ sol but only to a depth of ten mm, removed, blown out, dried, and calcined. The final catalyst had 25% $ZrO_2$ and 6.2% palladium on the inlet ten mm portion.

Stage 2

The second stage catalyst was prepared as follows:

A $ZrO_2$ colloidal sol was prepared. About 66 g of zirconium isopropoxide was hydrolyzed with 75 cc water and then mixed with 100 g of $ZrO_2$ powder with a surface area of 100 $m^2$/gm and an additional 56 ml of water. This slurry was ball milled in a polymer lined ball mill using $ZrO_2$ cylindrical media for eight hours. This colloidal sol was diluted to a concentration of 15% $ZrO_2$ by weight with additional water.

An Fe/Cr/Al alloy foil was corrugated in a herringbone pattern and then oxidized at 900° C. in air to form alumina whiskers on the foil surface. The $ZrO_2$ sol was sprayed on the corrugated foil. The coated foil was dried and calcined at 850° C. The final foil contained twelve mg $ZrO_2/cm^2$ foil surface.

Palladium 2-ethylhexanoic acid was dissolved in toluene to a concentration of 0.1 g palladium/mi. This solution was sprayed onto one side only of the $ZrO_2$ coated metal foil and the foil dried and calcined at 850° C. in air. The final foil contained about 0.5 mg palladium/$cm^2$ of foil surface.

The corrugated foil was rolled so that the corrugations did not mesh to form a final metal structure of two inch diameter and two inch length with longitudinal channels running axially through the structure and containing about 150 cells per square inch. The foil had palladium/$ZrO_2$ catalyst on one surface only and each channel consisted of catalytic coated and non-catalytic surfaces such as those shown in FIG. 1.

Stage 3

The third stage catalyst was prepared as follows:

An alumina sol was prepared. About 125 g of a gamma alumina with a surface area of 180 $m^2$/g, 21 ml of concentrated nitric acid, and 165 ml of water were placed in a half gallon ball mill with cylindrical alumina grinding media and milled for 24 hours. This sol was diluted to a solid concentration of 20%. An Fe/Cr/Al alloy foil was corrugated to form uniform straight channels in the foil strip. When rolled together with a flat foil strip, the spiral structure formed a honeycomb structure with straight channels. The corrugated strip was first sprayed with a 5% colloidal boehmite sol and then with the alumina sol prepared above. A flat strip of metal foil was sprayed in a similar fashion. Only one surface of each foil was coated in this manner. The foils were then dried and calcined at 1100° C.

$Pt(NH_3)_2(NO_2)_2$ was dissolved in nitric acid to produce a solution with 0.13 g platinum/mi. This solution was sprayed onto the coated foil, the foil treated with gaseous $H_2S$, dried, and calcined at 1100° C. The "thickness" of the alumina coating on the metal foil was about four mg/$cm^2$ of flat foil surface. The platinum loading was about 20% of the alumina.

Three Stage Catalyst System

Figure 2:
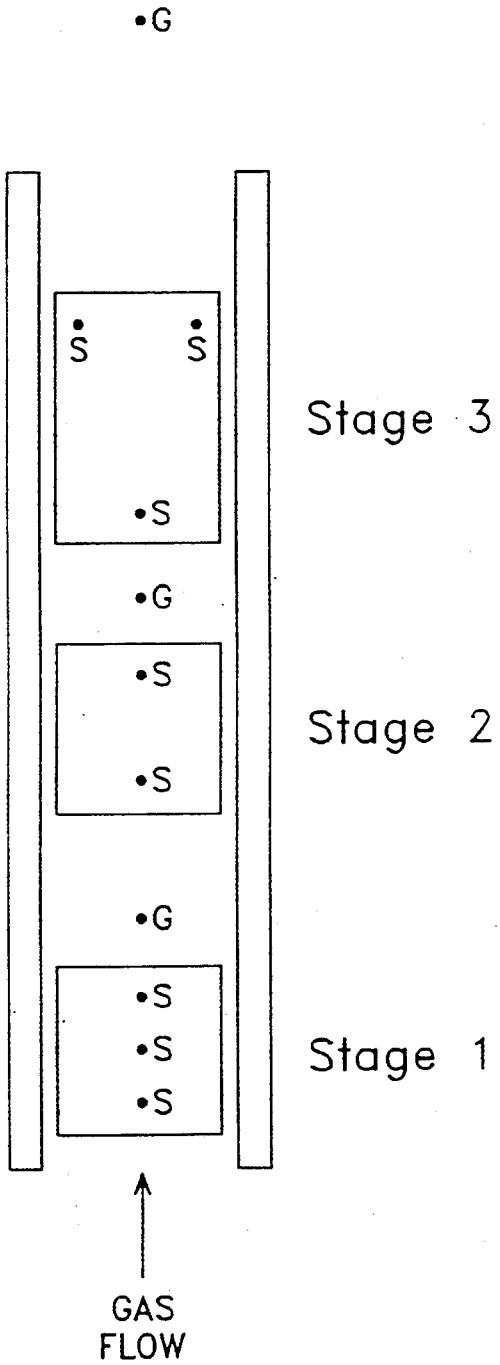
FIG. 2 is a schematic representation of the three stage catalytic reaction apparatus used in the Examples.
Figure 3:
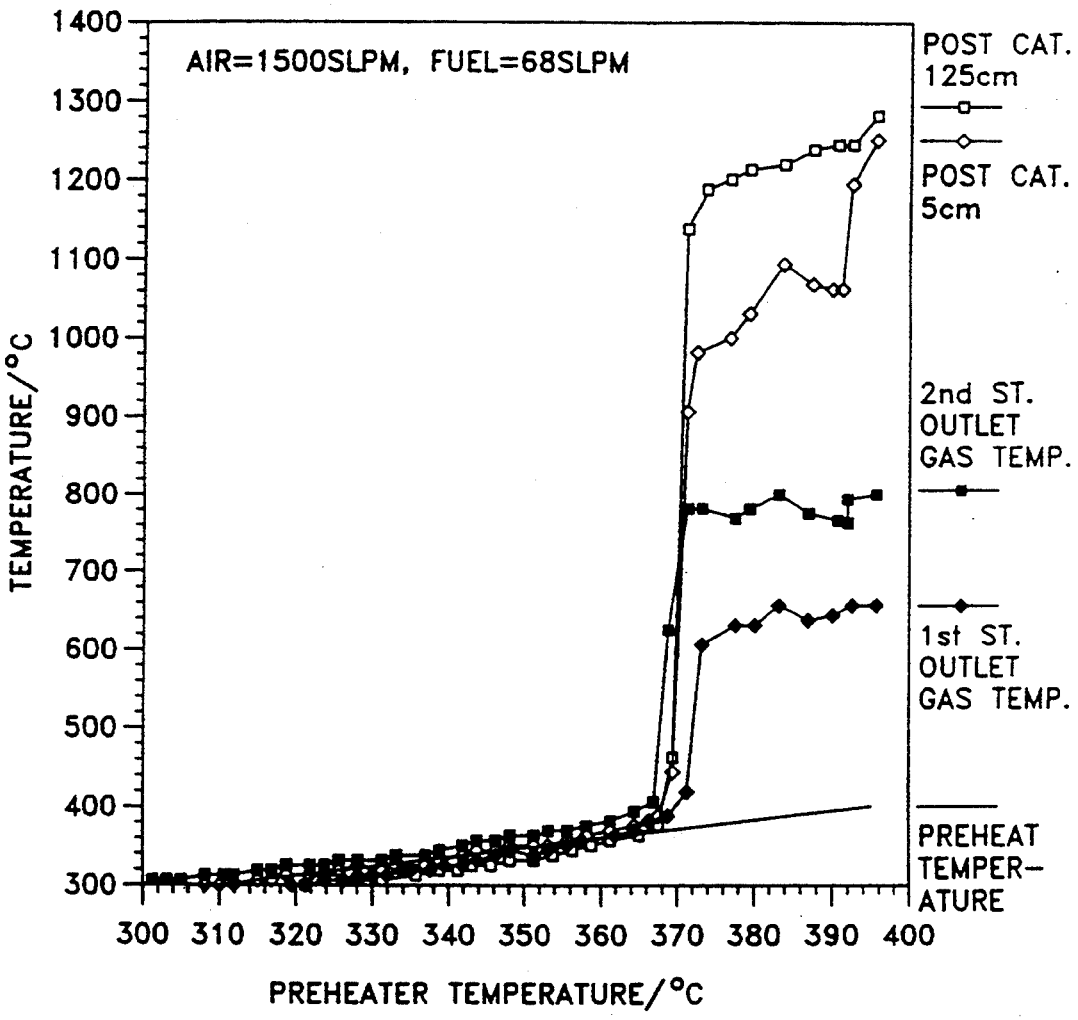
FIGS. 3 and 4 are graphs of various operating temperatures as a function of preheat temperature.
Figure 4:
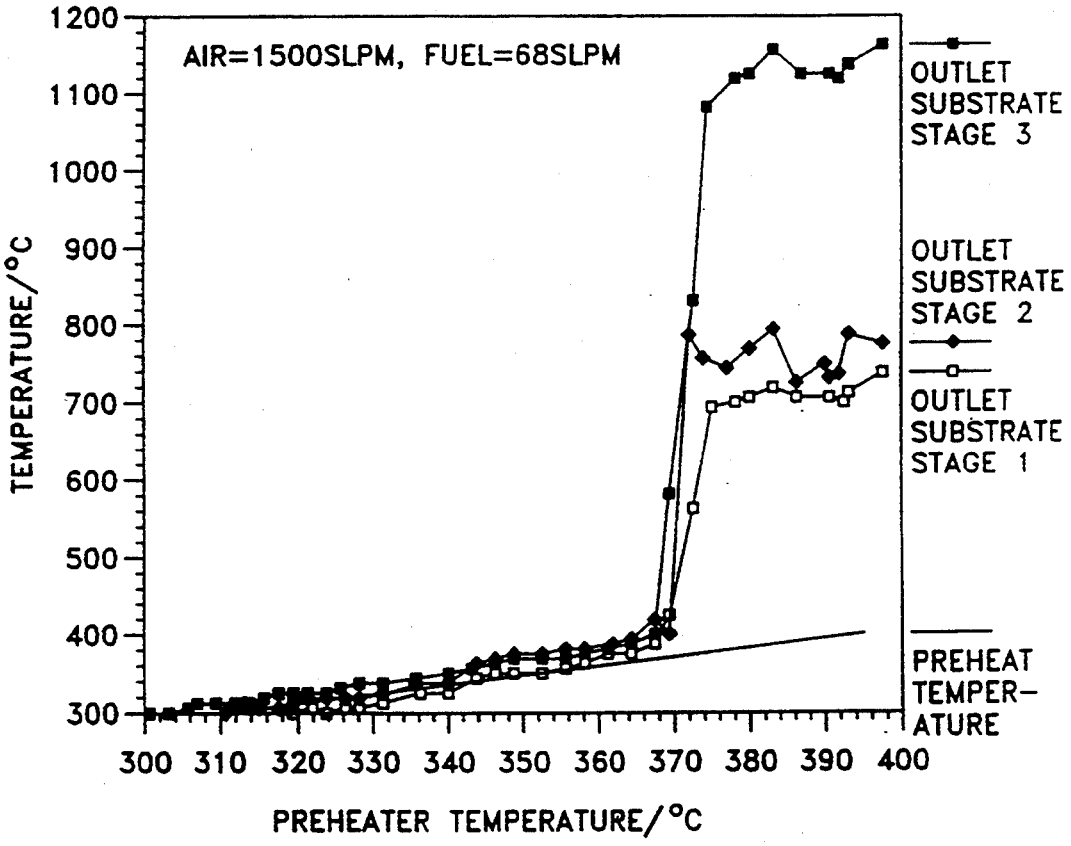

The three catalysts described above were arranged inside a ceramic cylinder as shown in FIG. 2. Thermocouples were located in this system at the positions shown. The thermocouples located in the catalyst sections were sealed inside a channel with ceramic cement to measure the temperature of the catalyst substrate. The gas thermocouples were suspended in the gas stream. The insulated catalyst section of FIG. 2 was installed in a reactor with a gas flow path of 50 mm diameter. Air at 1500 SLPM was passed through an electric heater, a static gas mixer, and through the catalyst system. Natural gas at 67 SLPM was added just upstream of the static mixer. The air temperature was slowly increased by increasing power to the electric heater. At 368° C., the gas temperatures from stages 1, 2, and 3 began to rise as shown in FIG. 3. Above a preheat temperature of 380° C., the gas temperature from stage 1 was constant at about 530° C., the gas exiting stage 2 was about 780° C., and the gas exiting stage 3 at approximately 1020° C. Homogeneous combustion occurred after the catalyst giving a gas temperature of about 1250° C.; a temperature near the adiabatic combustion temperature of this fuel/air ratio. The substrate temperatures for the three stages are shown in FIG. 4.

As was described above, the stage 1 catalyst lit off at a low temperature and substrate temperature self-limited at about 750° C. This catalyst cell density and gas flow rate produced an intermediate gas temperature of 540° C. Similarly, stage 2 also self-limited the substrate temperature to 780° C. and produced a gas temperature of 750° C. Stage 3 limited the wall temperature at 1100° C.

Figure 5:
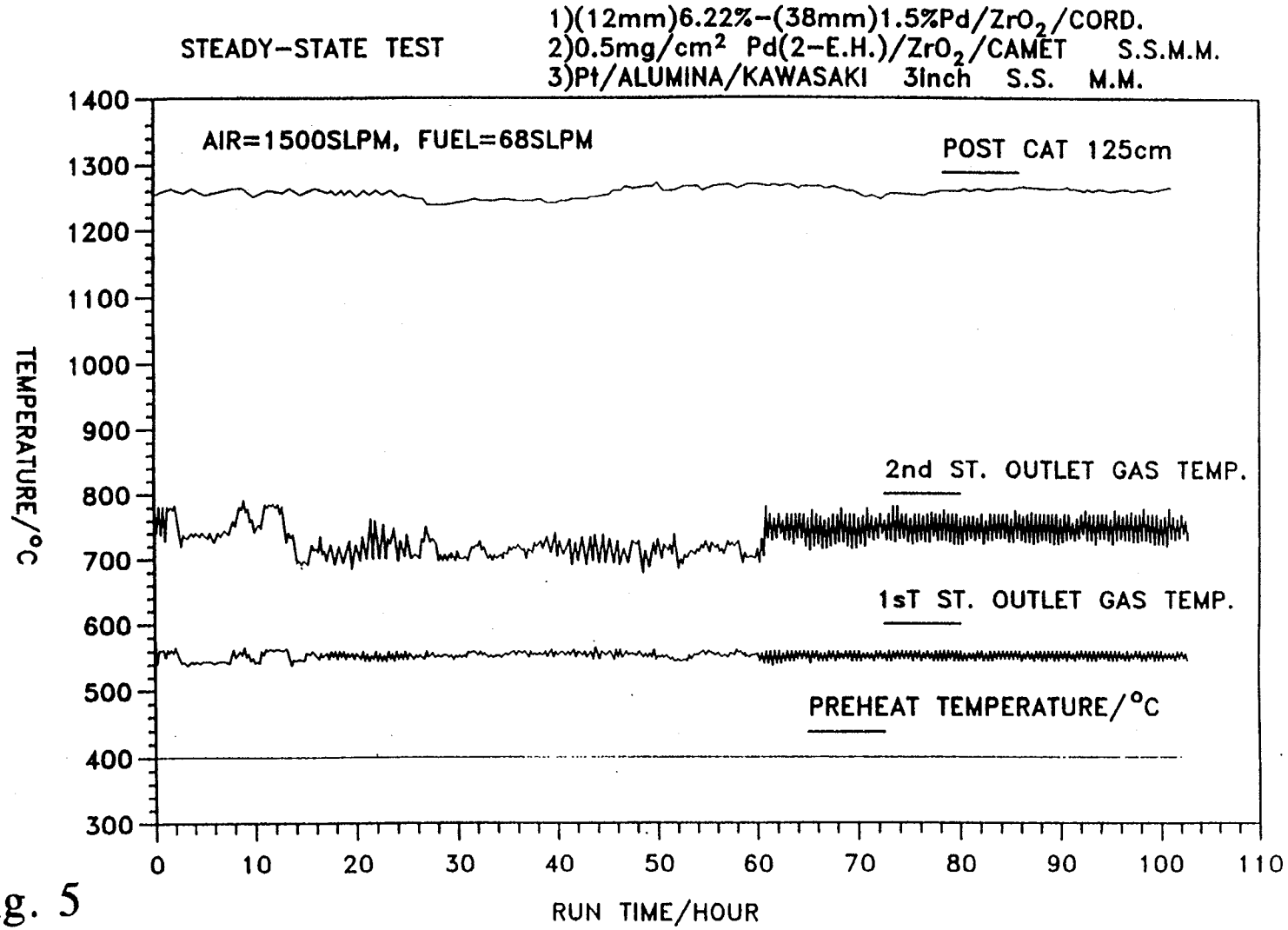
FIG. 5 is a graph of various operating temperatures during a long term steady state operation test.

Limiting the substrate temperature to 750° C. to 780° C. for stages 1 and 2 provided excellent long term catalyst stability. This stability was demonstrated for 100 hours as shown in FIG. 5.

Figure 6:
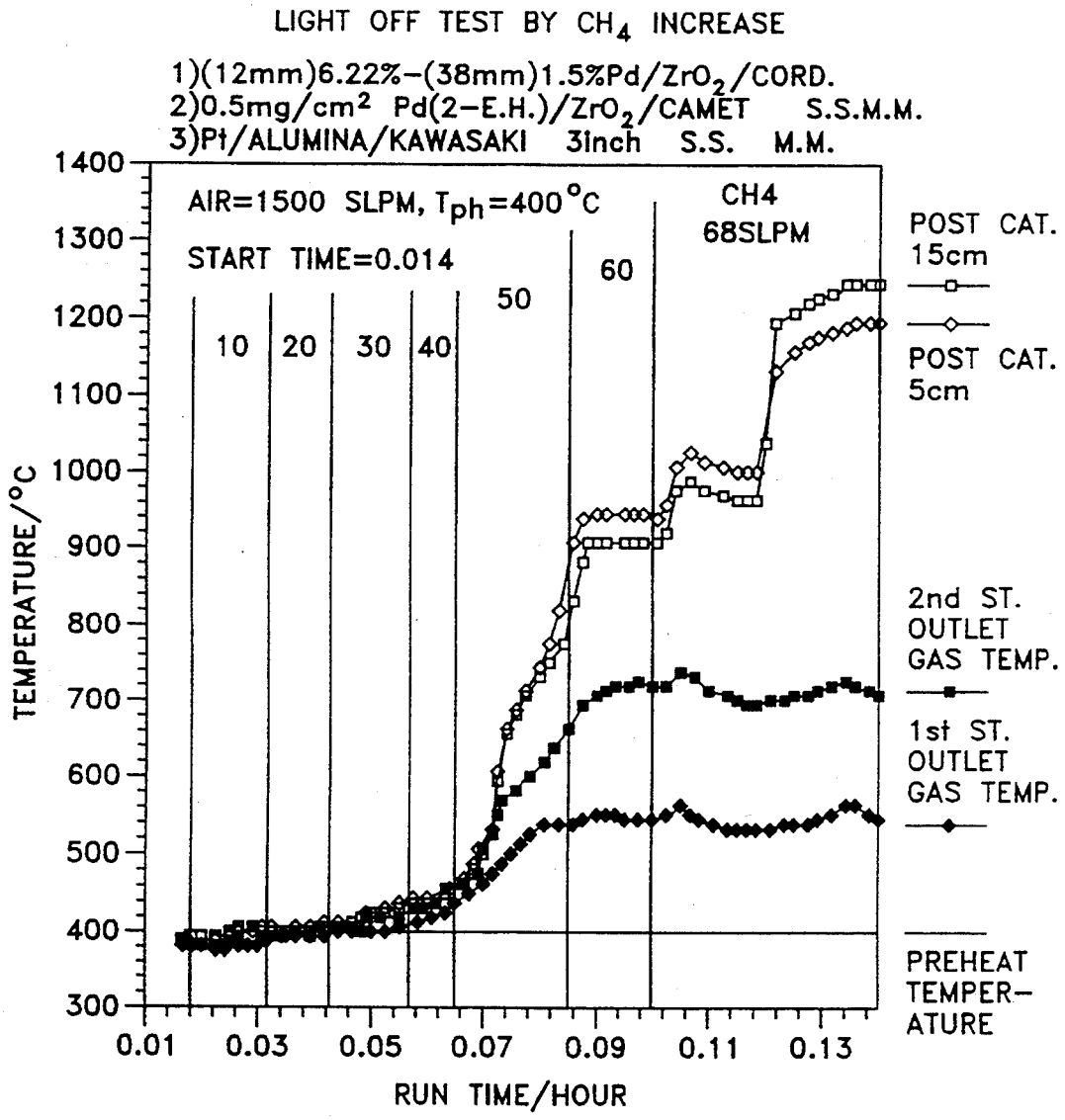
FIG. 6 is a graph of various operating temperatures during a typical start up procedure.

This catalyst system was again ignited by holding the inlet air temperature at 400° C. and increasing the fuel/air ratio by increasing the methane flow rate. This start-up procedure is shown in FIG. 6. Stage 1 achieved an outlet gas temperature of 540° C. at fuel/air=0.033 and maintained this temperature at fuel/air ratios up to 0.045. Complete homogeneous combustion after the catalyst was achieved at a fuel/air ratio of 0.045.

This invention has been shown both by direct description and by example. The examples are not intended to limit the invention as later claimed in any way; they are only examples. Additionally, one having ordinary skill in this art would be able to recognize equivalent ways to practice the invention described in these claims. Those equivalents are considered to be within the spirit of the claimed invention.

We claim as our invention:

1. A catalytic process for producing a combustion gas having a temperature between 1050° C. and 1700° C., the process comprising the steps of:

a. partially combusting a combustible mixture comprised of fuel and oxygen-containing gas and having a theoretical adiabatic combustion gas temperature in a catalytic structure having at least one stage wherein a catalyst is situated so that a portion of the combustible mixture is inhibited in its contact with the catalyst by the presence of a diffusion layer on the catalyst so that only a portion of the fuel is combusted within the catalytic structure and the temperature of the partially combusted combustible mixture discharged from the catalytic structure is below the theoretical adiabatic combustion temperature, and b. combusting the remainder of the fuel in the combustible mixture outside of the catalytic structure to produce a combustion gas having a temperature within the desired range of 1050° C. and 1700° C.

2. The process of claim 1 where the first stage catalyst comprises palladium, the second stage catalyst comprises palladium, and the third stage catalyst comprises platinum.

3. The process of claim 2 where the temperature of the combustible mixture discharged from the first stage is between 500° C. and 650° C. and that discharged from the second stage is between 750° C. and 800° C.

4. The process of claim 1 where the catalyst support is a corrugated metal structure.

5. The process of claim 1 where the catalytic structure in which catalytic material is situated so that a portion of the combustible mixture is inhibited in its contact with the catalytic comprises a catalyst support having catalyst with a diffusion barrier situated therein.

* * * * *